United States Patent [19]

Rosenthal

[11] Patent Number: 5,031,914

[45] Date of Patent: Jul. 16, 1991

[54] ELECTRONIC DICE GAME

[76] Inventor: Mark Rosenthal, 557 E. Market St., Long Beach, N.Y. 11561

[21] Appl. No.: 471,638

[22] Filed: Jan. 29, 1990

[51] Int. Cl.[5] ..... A63F 9/00; A63F 9/24

[52] U.S. Cl. ..... 273/146; 273/138 A; 273/85 CP

[58] Field of Search ..... 273/85 CP, 146, 138 A, 273/138 R, 237, 1 E

[56] References Cited

U.S. PATENT DOCUMENTS 3,709,499 1/1973 Lukens, Jr. ..... 273/138 A
3,715,624 2/1973 Herman ..... 273/138 A
4,181,308 1/1980 Fox et al. ..... 273/237
4,506,890 3/1985 Murry ..... 273/138 A
4,834,386 5/1989 Rosenthal et al. ..... 273/146

*Primary Examiner*—Edward M. Coven
*Assistant Examiner*—Jessica J. Harrison
*Attorney, Agent, or Firm*—Iman Abdallah

[57] ABSTRACT

A hand-held electronic dice game randomly generates pictorial representations of a plurality of die faces in display windows. Players' scores are determined by comparing wagers made by a player to a predetermined scoring schedule. The hand-held electronic disce game displays the score each turn and accumulated running scores.

2 Claims, 2 Drawing Sheets

ELECTRONIC DICE GAME

BACKGROUND OF THE INVENTION

The present invention generally relates to electronic games. More particularly, the present invention relates to a portable, hand-held electronic device for playing a game of chance.

In U.S. Pat. No. 4,834,386 a patent was granted to the present Applicant as a co-inventor for a method of playing a dice game. The object of the dice game generally comprises accumulating a score by adding points determined by random throws of a plurality of dice. A schedule of points is provided for one or a plurality of particular predetermined marking(s) on a single die or for three matching dice, and players in turn accumulate scores by removing a single die showing the particular predetermined marking and/or by removing the three matching dice from the plurality of dice. The remaining dice (or die) are then thrown for additional scoring. A player may score based on the numbers showing on the upward face or the bottom face of the dice (when "bottoms" is called prior to throwing the dice). A player "busts" when no three matching dice are thrown or when no no die showing the predetermined marking is thrown, and loses all points scored on that turn. The present invention comprises an electronic device for playing the game of the aforementioned patent.

SUMMARY OF THE INVENTION

The present invention discloses a hand-held electronic game device for a plurality of players comprising a quadrilateral housing member having a plurality of display windows disposed in the top face of the housing member in combination with means to display pictorial representations of the face of a die in a portion of said display windows, means to effect random display of said pictorial representations, means to display pictorial representations of the opposite face of a die in a second portion of said display windows, means to selectively display indicia for each player, means to determine and display the number of turns taken by each player in another display window in coordination with the display indicia, and means to accumulate and the display the scores for each player in coordination with the display indicia. The device also includes means to randomly select and display the face of a single die.

An object of the present invention is to provide an electronic device for playing a game of chance.

Another object of this invention is to provide an electronic device that accumulates and selectively displays the scores and the number of turns for each of a plurality of players.

These and other objects and advantages of the present invention will be apparent to those skilled in the art from the following description of a preferred embodiment, drawings and appended claims.

DESCRIPTION OF A PREFERRED EMBODIMENT

Figure 1:
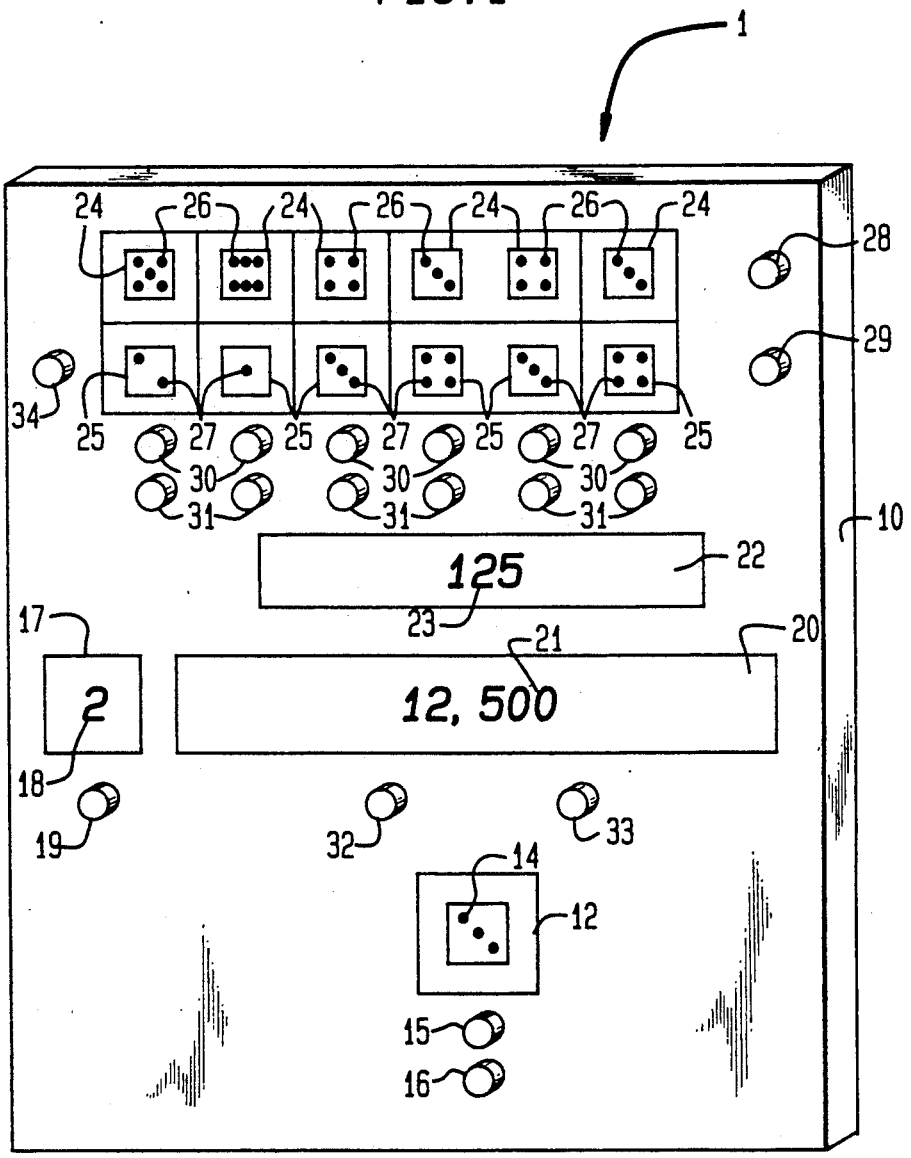
FIG. 1 is a front perspective view of the electronic device of the present invention.
Figure 2:
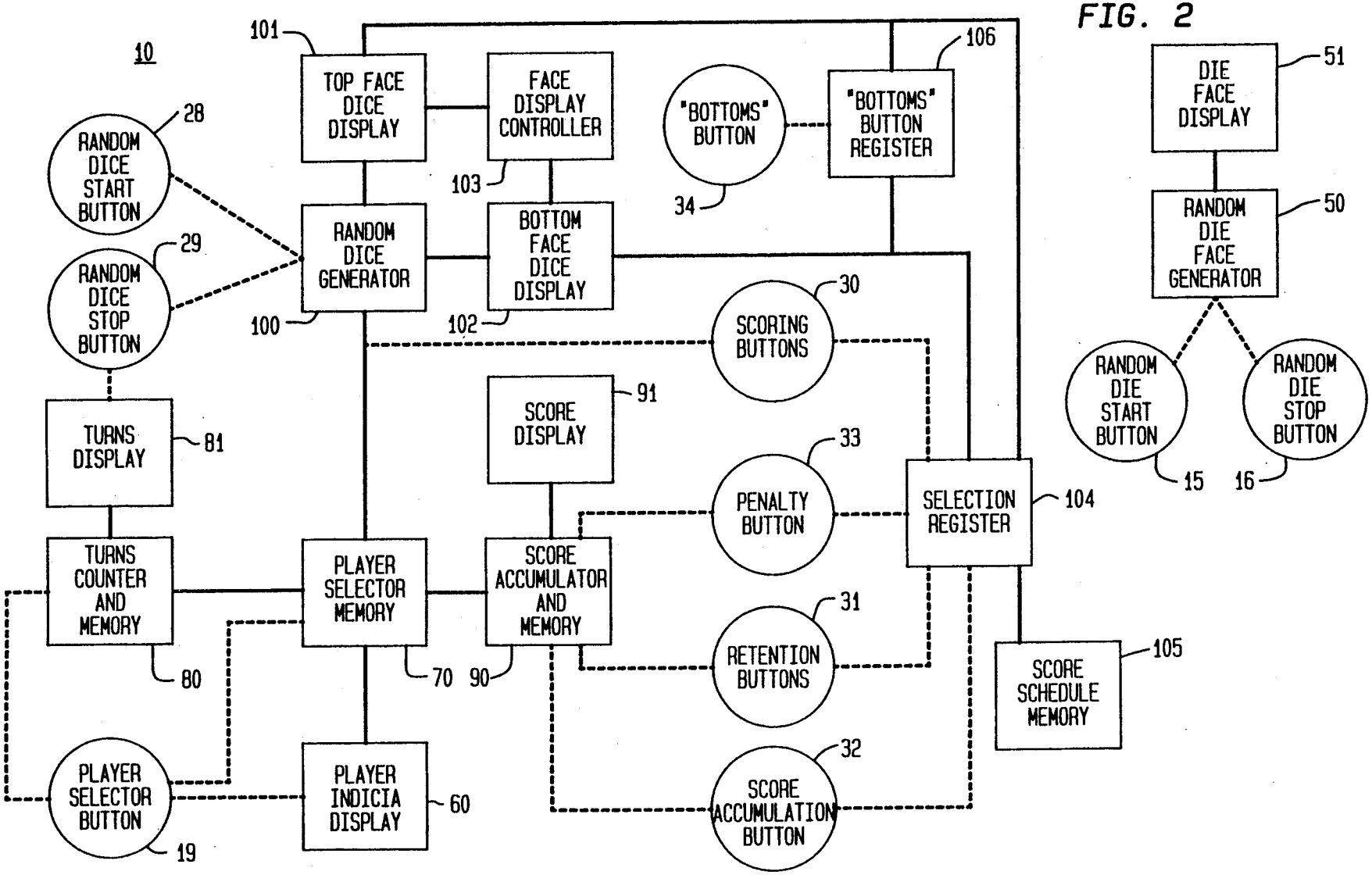
FIG. 2 is a block diagram of the electronic circuitry of the present invention.

To best understand the electronic device 1 of the present invention FIGS. 1 and 2 should be view in combination. Similar references in the respective figures are indicated by the same number. FIG. 1 illustrates in a front perspective view the electronic device 1 of the present invention. The device 1 generally comprises a quadrilateral housing member 10 having a plurality of display windows and a plurality of button activation means disposed in the top face 11 of said housing member 10. A first display window 12 is disposed in the lower portion of said top face 11 for display of the face of a single die 14. A random die start button 15 and a random die stop button 16 are vertically aligned below said first display window 12, said random die start button 15 and said random die stop button 16 being provided to selectively operate a random die face generator circuit 50 and a die face display circuit 51 (FIG. 2) contained within said housing member 10. The random die face generator circuit 50 includes means to randomly determine one of the faces of a die and the die face display circuit 51 includes means to display the die face that is randomly generated. The first display window 12, the random die start button 15 and the random die stop button 16 are utilized at the start of play as hereinafter described in greater detail.

A second display window 17 is disposed in the mid-portion of the top face 11 of the housing member 10 for display of an indicia 18 for each player, for example a number. A player selector button 19 is vertically aligned below said second display window 17 to selectively effect the display of the indicia 18 within said second display window 17 by operation of a indicia display circuit 60 contained within said housing member 10 (FIG. 2). A player selector memory 70 is also contained within said housing member 10 which communicates with a turns counter and memory circuit 80 and a score accumulator and memory circuit 90 contained within said housing member 10. Referring again to FIG. 1 it can be seen that said housing member 10 includes a third display window 20 disposed in horizontal alignment with said second display window 17 for display of the accumulated score 21 for each player by means of a score display circuit 91 contained within said housing member 10. The score display circuit 91 communicates with the player selector memory 70 via the score accumulator and memory circuit 90 so that the accumulated scores for a plurality of players can be selectively displayed by operation of said second button 19 (FIG. 2). Said housing member 10 further includes a fourth display window 22 disposed above said third display window 20 for display of the accumulated number of turns 23 for each player by means of a turns display circuit 81 contained within said housing member 10. The turns display circuit 81 communicates with the player selector memory 70 via the turns counter and memory circuit 80 so that the accumulated number of turns for a plurality of players can be selectively displayed by operation of said second button 19. Each time that a new player starts a turn by activating the second button 19, the turns counter and memory circuit 80 is cleared so that only the turns taken in succession are counted and displayed for each player. At the top portion of the top face 11 of said housing member 10 there is disposed a plurality of paired fifth and sixth display windows 24, 25, respectively disposed in vertical alignment, said fifth and sixth display windows 24, 25 being provided for the display of the face of a single die 26, 27 in each of the respective vertically aligned plurality of fifth and sixth display window 24, 25. The fifth display windows 24 display the face of a single die 26 and the sixth display windows 25 display the corresponding opposite face 27 of the vertically disposed single die 26 shown in the fifth display windows 24, that is, the face shown in said fifth display windows 24 and the corresponding vertically disposed face shown in said sixth display windows 25 at all times add up to the number seven. The control of what faces are displayed within the said fifth and sixth display windows 24 and 25 is by operation of a random dice start button 28 and a second stop button 29 disposed to one side of said fifth and sixth display windows 24, 25 which effect operation of a random dice generator 100 contained within said housing member 10, said random dice generator 100 communicating with a top face dice display circuit 101 and a bottom face dice display circuit 102. A face display controller 103 is disposed in communication between said top face dice display circuit 101 and said bottom face dice display circuit 102 to assure that the die faces 26 and 27 displayed in the respective vertically disposed fifth and sixth display windows 24 and 25 always add up to the number seven. A plurality of scoring buttons 30 and retention buttons 31 are disposed in vertical alignment below each of the plurality of fifth and sixth display windows 24, 25. The scoring buttons 30 and retention buttons 31 are selectively operated by the players and communicate with a selection register 104 contained within said housing member 10 (FIG. 2). The selection register 104 communicates with a score schedule memory circuit 105 which associates the selections made by operation of the scoring buttons 30 and the retention buttons 31 and recorded in said selection register 104 with predetermined scores for each of the possible selections. The score is transmitted to the selection register 104 by the score schedule memory circuit 105. A score accumulation button 32 and a penalty button 33 (FIG. 1) are respectively disposed adjacently below said third display window 20, said score accumulation button 32 and said penalty button 33 respectively communicating with said score accumulator and memory circuit 90 and said selection register 104, operation of said score accumulation button 32 causing the score accumulator and memory circuit 90 to add the scores transmitted to said selection register 104 and operation of said penalty button 33 causing the score accumulator and memory circuit 90 to subtract the scores transmitted to said selection register 104. A "bottoms" button 34 is disposed to one side of said sixth display window 25 and communicates with a "bottoms" button register 106 contained with said housing member 10 (FIG. 2), said "bottoms" button register 106 also serving as a decision gate between said top face display circuit 101 and a bottom face display circuit 102 and said selection register 104 to determine which plurality of selections will be considered in scoring.

The following description of play between two players illustrates the operation of the electronic device 1 of the present invention during play of the game of chance for which this device 1 is provided. Player 1 presses the random die start button 15 to initiate operation of the random die face generator circuit 50. After a few moments the random die stop button 16 is pressed to shut off the random die face generator circuit 50 which in turn activates the die face display circuit 51 to display a face of a single die 14 within said first display window 12. Player 2 repeats these steps. The player having the highest number showing on the face of the single die 14 takes the first turn. If the same number appears for both players, both players repeat the aforementioned steps. For illustration purposes assume Player 1 goes first. Player 1 then operates said the player selector button 19 to activate the player indicia display circuit 60 and display the indicia 18 for that player within the second display window 17. In this case the number "1" would be displayed. The activation of the indicia display circuit 60 activates the recording of the indicia 18 within the player selector memory 70 and thereby when the indicia display circuit 60 displays the number "1" the player selector memory 70 recalls that Player 1 is taking a turn. Player 1 then presses the random dice start button 28 to initiate the operation of said random dice generator 100 and after a few moments the random dice stop button 29 is pressed to stop the random dice generator 100. By operation of the random dice generator 100 the face of a single die 26, 27 is displayed in each of the plurality of fifth and sixth display windows 24, 25. The face display controller 103 checks for complementary display as heretofore described. Player 1 then selects a dice display that can score, for example, the "5" showing in the leftmost fifth display window 24 is selected by pressing the leftmost scoring button 30. This selection is registered in the selection register 104. A score associated with the "5" which is stored in the scoring memory 105 is displayed in the fourth display window 22 when the scoring accumulation button 32 is pressed. The score is simultaneously stored in the score accumulation and memory circuit 90. Player 1 then continues by again pressing the random dice start button 28 and the random dice stop button 29. If the player "busts," that is, no scoring die face 26 is displayed in a fifth display window 24, the penalty button 33 is pressed and the previous score accumulated and stored in the score accumulator and memory circuit 90 is halved. This score would then be displayed by operation of the score display circuit 91 in third display window 20. The number of turns taken by Player 1, in this case two turns would be counted and stored in the turns counter and memory circuit 80 and displayed in the fourth display window 22 by means of the turns display circuit 81. Player 2 now takes a turn and presses the player selector button 19 which also clears the turns counter and memory circuit 80. Assuming that Player 2 chooses to chance scoring by the "bottoms" of the die faces as shown in the sixth display window 25, the "bottoms" button 34 is pressed before the random dice start button 28 is pressed. By pressing the "bottoms" button 34 the "bottoms" button register 106 is activated which communicates to the selection register 104 this choice which readies the score schedule memory circuit 105 to score accordingly. Thereby when the scoring button 30 under the "1" in the second leftmost sixth display window 25 is chosen for scoring, the score schedule memory circuit 105 will make the appropriate association and the electronic circuitry operates as heretofore described for Player 1 until Player 2 "busts" or ends his/her turn.

The pictorial and numerical displays 14, 18, 21, 23, 26 and 27 in the respective display windows 12, 17, 20, 22, 24 and 25 are provided by means of light-emitting diodes or other suitable electronic visual display means as known in the prior art.

Various changes and modifications to the present invention as described for the preferred embodiment may be made without departing from the spirit and scope of the invention as held in the appended claims.

Therefore in view of the foregoing I claim:

1. A hand-held electronic device for playing a dice game by a plurality of players comprising a quadrilateral housing member;

a plurality of first display windows disposed in the top face of said housing member;

means to display within each of the first display windows a pictorial representation of the face of a die;

a plurality of second display windows corresponding in number to said plurality of first display windows disposed adjacently below said first display windows;

means to effect random shuffling and display of the pictorial representations within said first display window;

means to effect random display of pictorial representations of the opposite face of said pictorial representations within said plurality of second display windows;

a third window display window disposed in the top face of said housing member;

means of accumulating the number of turns taken by a player;

means of selectively displaying the accumulated number of turns taken by each player;

a fourth display window disposed in the top face of said housing member;

means of selectively summing and storing numerical representations of the pictorial representations for each player;

means of selectively displaying the stored sums for each player;

means of selecting display turns and sums;

a fifth display window disposed in the top face of said housing member to display pictorial representations of a die;

means to randomly generate pictorial representations within said fifth display window;

means to select first windows for summing;

means to select second windows for summing;

means to selectively remove one or a plurality of dice from random shuffling and accumulation;

means to select scores to be accumulated; and means to select "bust" or "50% penalty of score accumulated" on a turn.

2. A hand-held electronic device for play of a dice game comprising a housing member;

a first display window disposed in said housing member;

a random die start button;

a random die stop button;

a random die face generator circuit providing means to randomly determine a die face for display in said first display window by operation of said random die start button and said random die stop button;

a die face display circuit providing means to display the die face randomly generated;

a second display window disposed in said housing member;

a player selector button;

a player indicia display circuit communicating with said player selector button;

a player selector memory circuit communicating with said player selector button;

a turns counter and memory circuit communicating with said player selector button;

a turns display circuit communicating with said turns counter and memory circuit;

a third display window disposed in said housing member;

a score accumulator and memory circuit communicating with said player selector memory circuit;

a score display circuit communicating with said score accumulator and memory circuit;

a fourth display window disposed in said housing member;

a plurality of fifth display windows disposed in said housing member;

a plurality of sixth display window disposed in said housing member;

a random dice start button;

a random dice stop button;

a random dice generator circuit communicating with said random dice start button and said random dice stop button;

a top face display circuit communicating with said random dice generator circuit;

a bottom face display circuit communicating with said random dice generator circuit;

a face display controller communicating with said top face display circuit and said bottom face display circuit;

a plurality of scoring buttons communicating with said random dice generator circuit;

a selection register communicating with said plurality of scoring buttons;

a score schedule memory circuit communicating with said selection register;

a score accumulation button communicating with said selection register and said score accumulator and memory circuit;

a penalty button communicating with said selection register and said score accumulator and memory circuit;

a "bottoms" button; and a "bottoms" button register communicating with said top face dice display circuit and said bottom face dice display circuit.

* * * * *